United States Patent [19]

Seney

[11] 4,184,646

[45] Jan. 22, 1980

[54] YARN WINDING APPARATUS

[75] Inventor: John S. Seney, Seaford, Del.

[73] Assignee: E. I. Du Pont de Nemours and Company, Wilmington, Del.

[21] Appl. No.: 880

[22] Filed: Jan. 4, 1979

[51] Int. Cl.[2] ..... B65H 54/52; B65H 59/38

[52] U.S. Cl. ..... 242/45; 73/160; 219/499; 242/18 DD

[58] Field of Search ..... 242/45, 75.5, 75.51, 242/75.52, 18 DD, 75.53, 18 B; 73/144, 160; 219/499, 497, 501; 323/22 SC

[56] References Cited

U.S. PATENT DOCUMENTS

| | | | |
|---|---|---|---|
| 3,216,279 | 11/1965 | White | 242/75.53 X |
| 3,375,347 | 3/1968 | Seney | 219/499 |
| 3,638,873 | 2/1972 | Cole | 242/45 |
| 3,670,980 | 6/1972 | Mukai et al. | 242/75.53 X |
| 3,697,007 | 10/1972 | Taylor et al. | 242/18 DD |
| 3,743,202 | 7/1973 | Haffsommer et al. | 242/45 |
| 4,067,234 | 1/1978 | Seney | 73/144 |

*Primary Examiner*—Stanley N. Gilreath

[57] ABSTRACT

An electropneumatic system to control yarn tension in a yarn winding apparatus in which an electrical resistance strain transducer is associated with the yarn line being wound for generating a signal indicative of tension. This signal regulates a motor driven valve which controls pneumatic pressure used to regulate the winding apparatus. A heat responsive negative feedback control is coupled into the system shunting the electrical resistance strain gauge to provide an anticipating signal to minimize overshoot in the control system.

1 Claim, 1 Drawing Figure

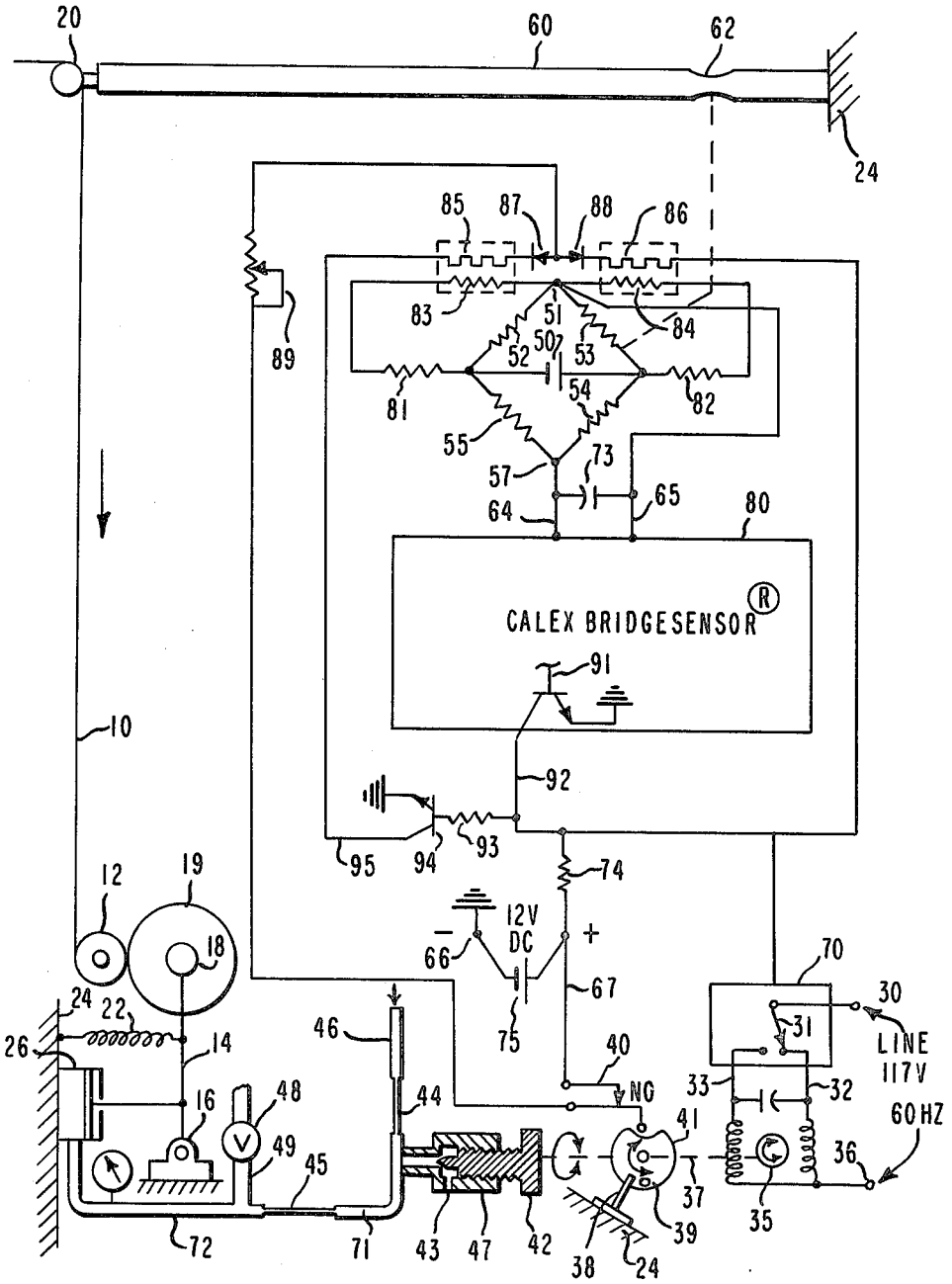
CALEX BRIDGESENSOR®
12V DC
LINE 117V
60HZ
NO

YARN WINDING APPARATUS

DESCRIPTION

Technical Field

This invention relates to measurement and control of tension in a moving elongated flexible element such as a threadline and more particularly to a control system for regulating the force between a drive roll in surface driven engagement with a yarn package and the yarn package.

BACKGROUND ART

Control systems for regulating force between a drive roll and a yarn package driven by the roll are known. For example, Seney in U.S. Pat. No. 4,067,234 describes a strain transducer for measuring threadline tension in a moving threadline and a pneumatic control system responsive to the transducer for regulating the force between a drive roll in surface driven engagement with a threadline package and the package. Such systems unless operated at extremely slow rates produce severe hunting and because of this are unsatisfactory.

To circumvent this problem a negative feedback voltage generating bridge similar to that shown in Seney's U.S. Pat. No. 3,375,347 is used in connection with the strain transducer and a particular control system to assure that regulation of tension does not over or under shoot the set point by a wide margin.

SUMMARY OF THE INVENTION

The apparatus according to the invention is a yarn winding apparatus comprising: a drive roll in surface driven engagement with a yarn package onto which a running yarn line is wound under tension; an electrical resistance strain gauge transducer for measuring tension in the yarn line and generating a voltage proportional thereto; an electropneumatic control system responsive to said voltage for regulating the force between said drive roll and said yarn package; a heat responsive negative feedback voltage generating resistance bridge circuit connected to said electrical resistance strain gauge transducer to shunt the output thereof; and means for heating a portion of said negative feedback bridge circuit to change the resistance thereof.

BRIEF DESCRIPTION OF THE DRAWING

The drawing is a schematic diagram of an electrical tension sensing circuit coupled with a pneumatic servo control system employed to regulate the pressure between a windup package and its drive roll.

DETAILED DESCRIPTION OF THE ILLUSTRATED EMBODIMENT

Referring to the drawing, it will be seen that the windup chosen for purposes of illustration includes as components thereof a driven surface drive roll 12, swing arm 14 mounted for relative rotation about pivot 16 and rotatably supporting bobbin 18, and a fanning guide 20 around which yarn 10 advances from a source (not shown) under drive roll 12 to package 19 being wound on bobbin 18. The package 19 is held in contact with the drive roll 12 by spring 22 connected between the windup frame 24 and the swing arm 14 above pivot 16. To change the winding tension in the yarn 10 the winding speed of package 19 is varied by varying the contact pressure between package 19 and drive roll 12 to produce the slip necessary to raise or lower the individual package's winding speed to maintain the winding tension of yarn 10 about a set point.

The mechanism for varying the contact pressure between package 19 and drive roll 12 includes an air cylinder 26 connected between the frame 24 and the swing arm 14 that can produce a force counter to spring 22 when pressure is applied to it through line 72 which is fed from a source (not shown) through air line 46, restriction 44, line 71 and restriction 45. Air line 71 is also connected to rotary valve 47 and provides a path through port 43 to atmosphere for air supplied through line 46 and restriction 44. An air dump valve 48 is connected into line 72 via pipe 49. Opening this valve provides an instantaneous means to release any pressure in cylinder 26.

Rotary valve 47 is driven by a capacitor run synchronous motor 35 via slip-clutch coupling shaft 37 connected to valve stem 42. Also driven by shaft 37 is a cam 41 which operates switch 40. Stop pins 38, 39 limit the motion of cam 41. Motor 35 is connected to 117 volt power source at terminals 30 and 36 through lines 32 or 33 and solid state contact 31 of the single pole double throw solid state switch 70.

As previously described the yarn line 10 on its way to package 19 passes over fanning guide 20 which is attached to the end of tension sensing beam 60. Tension beam 60 has a reduced portion 62 in which is installed a four arm strain gauge bridge composed of resistance elements 52, 53, 54 and 55. The bridge is powered by a D.C. source 50 and generates a voltage at terminals 51 and 57 on the bridge proportional to the out of balance of the bridge resistance elements caused by the tension in the yarn 10 passing over fanning guide 20. The terminals 51 and 57 are connected to a Calex Bridgesensor ® 80 (Model 165A manufactured by Calex Manufacturing Co., Inc., Pleasant Hill Calif. via lines 64 and 65. An antihunting circuit comprised of a negative feedback voltage generating bridge consisting of resistors 81, 82, 83 and 84 is connected to shunt the output of strain gauge resistors 52 and 53. The resistors 83 and 84 are each made from a 100 ohm length of 0.002 inch (0.00508 cm) diameter Balco ® (a registered trademark of Wilbur B. Driver Co. for a magnetic alloy composed of 30% iron and 70% nickel and used for electric voltage resistors) wire which has a high temperature coefficient of resistance, and are wound around and are thermally bonded to $\frac{1}{4}$ watt 1000 ohm resistors forming heaters 85 and 86. A 12 volt D.C. power source 75 is connected to heaters 85 and 86 through line 67 connected to the positive side of the source switch 40 then variable resistor 89 to diodes 87 and 88 connected to heaters 85 and 86 respectively. The positive side of D.C. source 75 also connects to a buffer resistor 74 which in turn is connected to base resistor 93 of transistor switch 94, double throw switch 70 and heater 86. Calex Bridgesensor ® 80 includes a transistor switch 91 connected to base resistor 93 of transistor 94 via line 92. Transistor 94 is then connected to heater 85 completing the circuit.

In operation, yarn line 10 is fed at a substantially constant speed over the fanning guide 20 which is attached to the sensing beam 60. Since the yarn changes direction at the guide 20, a downward force is applied to beam 60 causing a slight stress at the thin section 62 of the beam. The strain gauge bridge in section 62 generates a voltage at points 51 and 57 proportional to the out-of-balance in the bridge elements caused by the tension in the yarn passing over guide 20. This output is fed to the Calex Bridgesensor® 80 which amplifies such input, provides an analog output proportional to the input and has an adjustable set point controlling the on-off state of transistor 91. In a typical example the Calex Bridgesensor® 80 has a set point corresponding to 275 grams, and an input on lines 64 and 65 higher than set point of 275 grams triggers transistor switch 91 to conduction state causing the switch 70 to connect 117 volts into line 32 through solid state contact 31. This causes the motor 35 to run in a clockwise direction closing valve 47. When valve 47 is open, air pressure in line 71 is near zero because air is continuously bleeding out of port 43 in the valve 47. However, when valve 47 is closed the pressure in line 71 raises to line pressure introduced at line 46 forcing air through restrictor 45 into line 72 and then into cylinder 26 which produces a force counter to spring 22 thus reducing the contact pressure between drive roll 12 and winding package 19 causing slip between the two surfaces which lowers winding tension. When the tension in yarn line 10 drops below the set point (275 grams) the transistor switch 91 becomes nonconducting and the solid state switch 70 shifts contact 31 to lead 33 causing motor 35 to reverse direction and open valve 47, bleeding air in the cylinder 26 to atmosphere through port 43 allowing the spring 22 to increase drive roll and package contact pressure thus raising winding tension.

The negative feedback voltage generating bridge comprised of resistors 81, 82, 83 and 84 has been provided to prevent severe hunting in the above described system and operates as follows: when transistor switch 91 is not conducting, i.e. tension in yarn line is below the 275 gram set point of the Calex Bridgesensor® 80, little voltage is dropped across the buffer resistor 74 feeding transistor 91 from 12 volt D.C. source 75 and the voltage on line 92 rises to about 12 volts which biases transistor 94 "on" through base resistor 93. This allows current to flow from line 67 through cam operated switch contacts 40 through adjustable resistor 89 through diode 87 into heater 85 back through line 95 through transistor 94 to ground which is the other side of the 12 volt D.C. supply 75. This heats the strain gauge biasing resistor 83 changing its resistance and causing the strain gauge output voltage to rise to a higher value than the strain produced by the tension in yarn 10. When this voltage reaches the set point value corresponding to 275 grams transistor 91 switches to a conduction state before the tension in yarn line 10 reached the set point. Conduction of transistor 91 causes current to flow from source 75 through line 67, contacts 40, adjustable resistor 89, through diode 88, through heater 86 and back through transistor 91 to ground. Since line 92 is connected to ground by conduction of transistor 91, the transistor 94 is no longer biased "on" and ceases to conduct thus allowing heater 85 to cool while heater 86 is heating the strain gauge biasing resistor 84 which in turn causes the output of the tension measuring bridge to be below the actual strain level of the yarn line 10.

In this manner motor 35 will be reversed before set point is reached by the tension in the yarn line to minimize overshoot. The motor rapidly adjusts control valve 47 to a position that produces a yarn line tension that balances the heat difference in heaters 85 and 86 to satisfy the set point. The "on"—"off" times of switch 91 quickly become equal and the motor 35 rapidly oscillates clockwise then counterclockwise holding valve 47 at the opening required to develop an air pressure in cylinder 26 that produces the set point winding tension of 275 grams in yarn line 10. When this happens true set point is achieved by the output from the tension measuring bridge since the effect of resistances 83 and 84 balance out.

Provisions are made to prevent overheating of the negative feedback resistors 83, 84 when the yarn line 10 is broken, or some other defect in the process occurs to produce problems beyond the capacity of the control system. In such cases the control valve 47 is rotated by motor 35 through a range of 270° and then travel is limited by fixed pin 38 engaging cam mounted pin 39. At this point because of the depression in cam 41 contacts 40 which drop into the depression open to remove all power to the heaters 85, 86.

Dump valve 48 is opened at the time of doffing a package to instantaneously raise the yarn line tension by releasing the pressure in cylinder 26 allowing the spring 22 to increase pressure between the drive roll and the package.

What is claimed is:

1. A yarn winding apparatus comprising: a drive roll in surface driven engagement with a yarn package onto which a running yarn line is wound under tension; an electrical resistance strain gauge transducer for measuring tension in the yarn line and generating a voltage proportional thereto; an electropneumatic control system responsive to said voltage for regulating the force between said drive roll and said yarn package; a heat responsive negative feedback voltage generating resistance bridge circuit connected to said electrical resistance strain gauge transducer to shunt the output thereof; and means for heating a portion of said negative feedback bridge circuit to change the resistance thereof.

* * * * *